US012089708B2

(12) United States Patent
Gupta

(10) Patent No.: US 12,089,708 B2
(45) Date of Patent: Sep. 17, 2024

(54) CASE FOR TAILOR'S CHALK

(71) Applicant: Nikhil Gupta, Schaumburg, IL (US)

(72) Inventor: Nikhil Gupta, Schaumburg, IL (US)

( * ) Notice: Subject to any disclaimer, the term of this patent is extended or adjusted under 35 U.S.C. 154(b) by 33 days.

(21) Appl. No.: 17/668,932

(22) Filed: Feb. 10, 2022

(65) Prior Publication Data

US 2022/0265017 A1 Aug. 25, 2022

Related U.S. Application Data

(60) Provisional application No. 63/283,486, filed on Nov. 28, 2021, provisional application No. 63/151,655, filed on Feb. 20, 2021.

(51) Int. Cl.

| | |
|---|---|
| ***A45C 11/24*** | (2006.01) |
| ***A45C 13/00*** | (2006.01) |
| ***A45C 15/00*** | (2006.01) |

(52) U.S. Cl.

CPC ..... *A45C 11/24* (2013.01); *A45C 13/004* (2013.01); *A45C 15/00* (2013.01); *A45C 2200/10* (2013.01)

(58) Field of Classification Search

CPC ..... B65D 2517/0073; B65D 2517/0076
See application file for complete search history.

(56) References Cited

U.S. PATENT DOCUMENTS 5,002,182 A * 3/1991 McGinnis ..... B43K 23/04 30/453
5,860,549 A * 1/1999 Allers ..... B65D 25/10 220/4.23

(Continued)

OTHER PUBLICATIONS

Amazon, Dritz Sew 101 27507 Tailor's Chalk & Holder with Sharpener, White , Blue, (May 23, 2017), Amazon (Year: 2017).*

(Continued)

*Primary Examiner* — Ernesto A Grano
*Assistant Examiner* — Symren K Sanghera
(74) *Attorney, Agent, or Firm* — Dunlap Bennett & Ludwig, PLLC; Anna L. Kinney

(57) ABSTRACT

A case for tailor's chalk includes: (a) a generally triangular base with a central portion, a retaining pocket along one edge thereof, said pocket opening toward the center of said triangular base and a pair of offset base hinge elements adjacent the pocket located adjacent opposed ends of said pocket along said one edge of said base; and (b) a generally triangular lid shaped and adapted to mate with the base and hinged thereto by a pair of mating offset lid hinge elements located along one edge of said generally triangular lid, said lid hinge elements being snap-fit mateable with said base hinge elements, the offset between said generally triangular base and said generally triangular lid being sufficient to define a storage cavity for the chalk in a closed position, the lid having a central portion opposing the central portion of the base in said closed position, the lid being coupled to the base so as to be rotatable with respect thereto to an open position where the lid is rotated by 180° with respect to the closed position and the chalk is accessible and wherein further the lid is rotatable with respect to the base to a work stand position where the lid is rotated by more than 270° with respect to the closed position such that the base is in an erect open position leaning at least slightly rearwardly where the chalk is accessible to a user.

20 Claims, 5 Drawing Sheets

(56) References Cited

U.S. PATENT DOCUMENTS

| | | | | |
|---|---|---|---|---|
| 6,694,988 | B2 | 2/2004 | Blazek | |
| 10,051,938 | B1 | 8/2018 | Kim | |
| 2002/0139708 | A1* | 10/2002 | Lien | B65D 83/04 206/534 |
| 2006/0000728 | A1* | 1/2006 | Lee | A45C 11/008 206/361 |
| 2019/0246759 | A1* | 8/2019 | Pineiro | B43K 31/00 |
| 2020/0239208 | A1* | 7/2020 | Lam | B65D 55/024 |
| 2021/0146705 | A1* | 5/2021 | Chiles | B41K 1/54 |
| 2022/0104599 | A1* | 4/2022 | Siebert | A45D 33/24 |

OTHER PUBLICATIONS

Engineering Product Design, Injection moulding surface finish design guide—DfM, (Oct. 1, 2022), Engineering Product Design, p. 8 (Year: 2022).*

* cited by examiner

CASE FOR TAILOR'S CHALK

CLAIM FOR PRIORITY

This Non-Provisional patent application is based on U.S. Provisional Patent Application Ser. No. 63/151,655, filed on Feb. 20, 2021, and U.S. Provisional Patent Application Ser. No. 63/283,486, filed on Nov. 28, 2021, both entitled "Case for Tailor's Chalk". Priorities of both Application Nos. 63/151,655 and 63,283,486 are claimed and the disclosures of both applications are incorporated by reference.

TECHNICAL FIELD

The present invention is directed to a protective case for tailor's chalk which also operates as a work stand for the chalk.

BACKGROUND

Tailor's chalk is widely used and is typically sold in boxes with a multiplicity of chalk pieces. Tailor's chalk is quite brittle, however, and there is a need for a protective case sized to accommodate individual pieces. So, also, tailor's chalk is used in workspace environments that are often cluttered, making it difficult to keep track of the chalk so that it is readily accessible to a user undertaking multiple tasks.

SUMMARY OF INVENTION

There is provided in accordance with the present invention a protective case for individual pieces of tailor's chalk. The case has a rotatable lid which is adapted to maintain the base in an erect position, such that the case is also operable as a work stand for the chalk.

In particular, there is provided a case for tailor's chalk comprising: (a) a base with a central portion, a retaining pocket at one edge thereof and a pair of base hinge elements adjacent the pocket; and (b) a lid shaped and adapted to mate with the base and hinged thereto by a pair of lid hinge elements to define a storage cavity for the chalk in a closed position, the lid having a central portion opposing the central portion of the base in said closed position, the lid being coupled to the base so as to be rotatable with respect thereto to an open position where the lid is rotated by 180° with respect to the closed position such that the chalk is accessible and wherein further the lid is rotatable with respect to the base to a work stand position where the lid is rotated by more than 220° with respect to the closed position, suitably from 270° to 315° with respect to the closed position, such that the base is in an erect open position where the chalk is accessible to a user.

Inasmuch as tailor's chalk is relatively soft and periodically requires sharpening to maintain a suitable marking edge, a preferred embodiment of the present invention includes a roughened surface suitable for sharpening the chalk as discussed herein.

In one aspect of the present invention, a case for tailor's chalk comprises: (a) a generally triangular base with a central portion, a retaining pocket along one edge thereof, said pocket opening toward the center of said triangular base and a pair of offset base hinge elements adjacent the pocket located adjacent opposed ends of said pocket along said one edge of said base; and (b) a generally triangular lid shaped and adapted to mate with the base and hinged thereto by a pair of mating offset lid hinge elements located along one edge of said generally triangular lid, said lid hinge elements being snap-fit mateable with said base hinge elements, the offset between said generally triangular base and said generally triangular lid being sufficient to define a storage cavity for the chalk in a closed position, the lid having a central portion opposing the central portion of the base in said closed position, the lid being coupled to the base so as to be rotatable with respect thereto to an open position where the lid is rotated by 180° with respect to the closed position and the chalk is accessible and wherein further the lid is rotatable with respect to the base to a work stand position where the lid is rotated by more than 270° with respect to the closed position such that the base is in an erect open position leaning at least slightly rearwardly where the chalk is accessible to a user.

Further features and advantages will be apparent from the following description and appended drawings.

BRIEF DESCRIPTION OF DRAWINGS

The invention is described in detail below with reference to the appended drawings, wherein like numerals designate similar parts and wherein.

DETAILED DESCRIPTION

Figure 2:
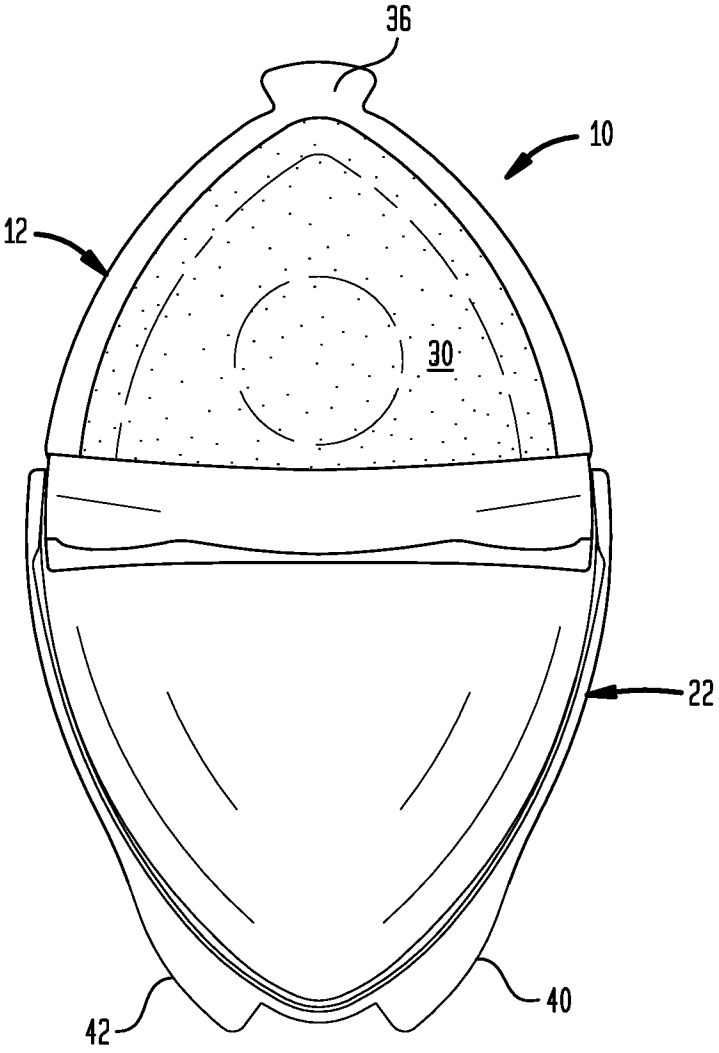
FIG. 2 is a plan view of the assembled case for tailor's chalk containing an individual piece of tailor's chalk of FIG. 1 in an open position, wherein the lid has been rotated 180° with respect to the base in the closed position of FIG. 1.
Figure 3:
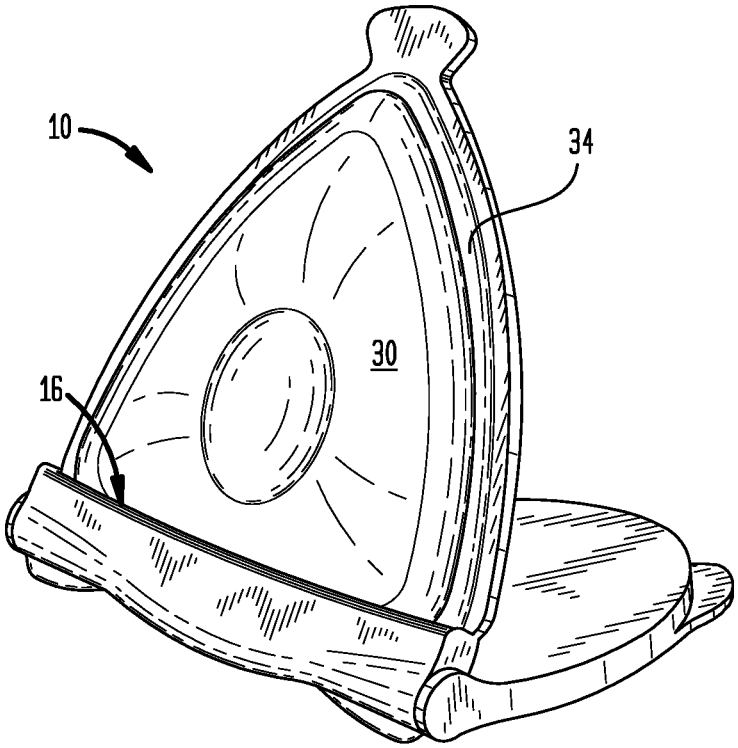
FIG. 3 is a perspective view of the assembled case in a work stand position, wherein the lid has been rotated slightly more than approximately 270° with respect to the base in the closed position of FIG. 1, with the case containing an individual piece of tailor's chalk of FIG. 1.
Figure 4:
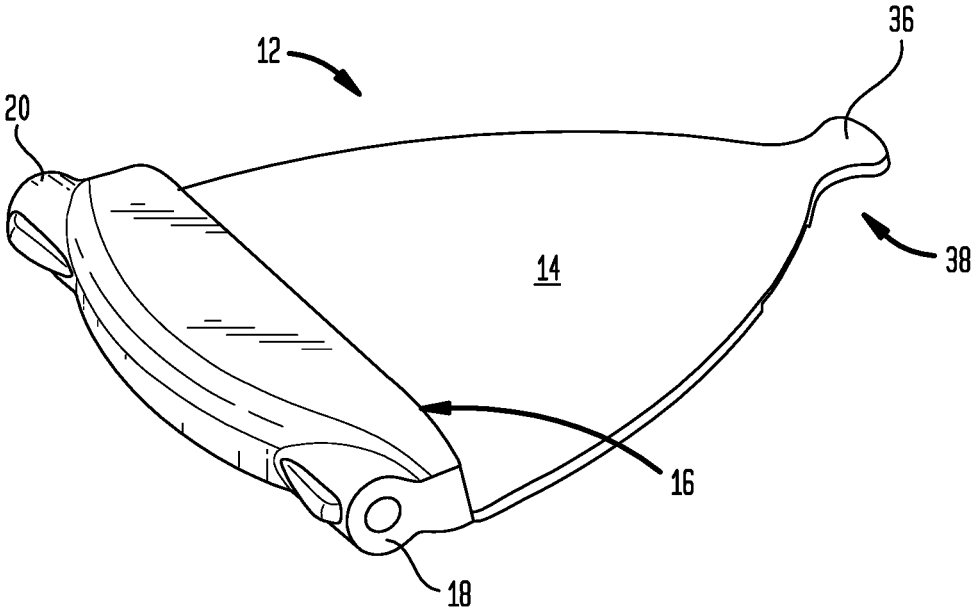
FIG. 4 is a perspective view of the base of the case for tailor's chalk.
Figure 5:
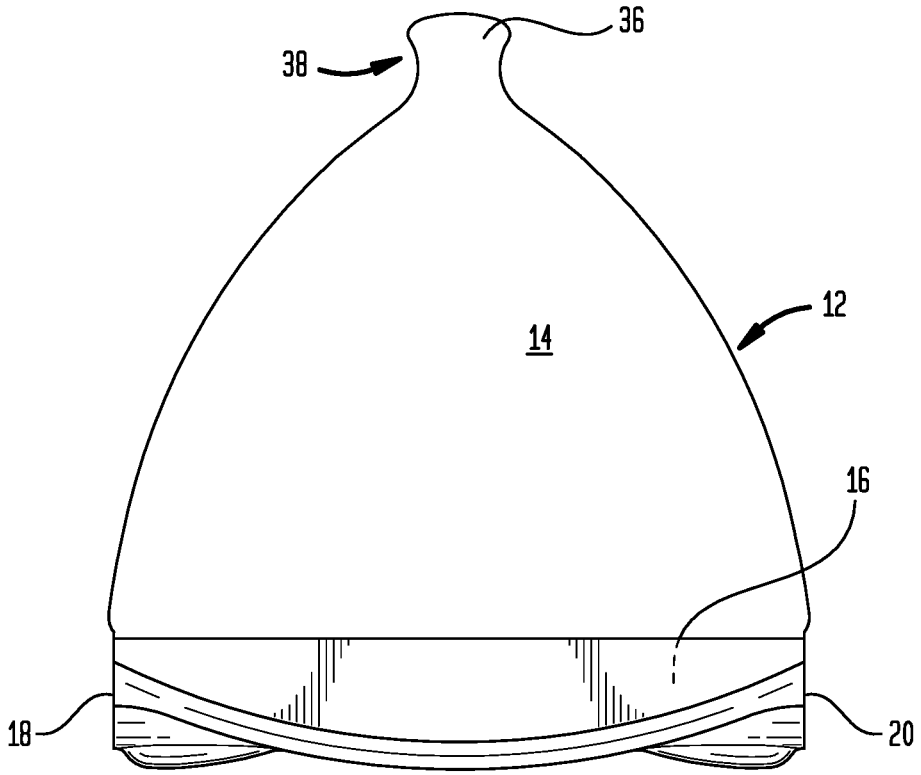
FIG. 5 is a plan view of the base of FIG. 4.
Figure 6:
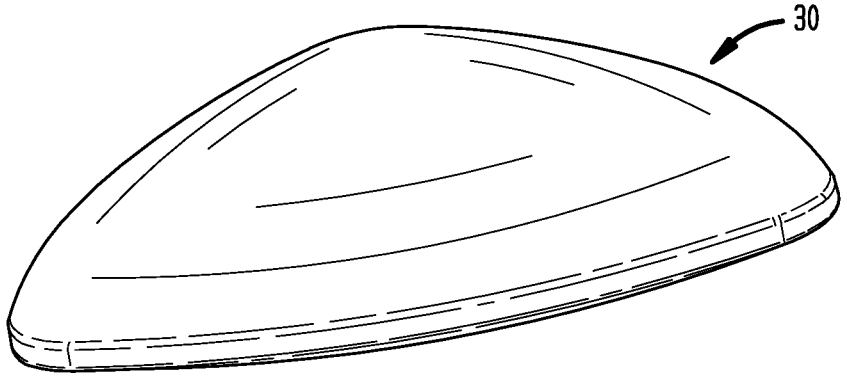
FIG. 6 is a perspective view of an individual piece of tailor's chalk.
Figure 7:
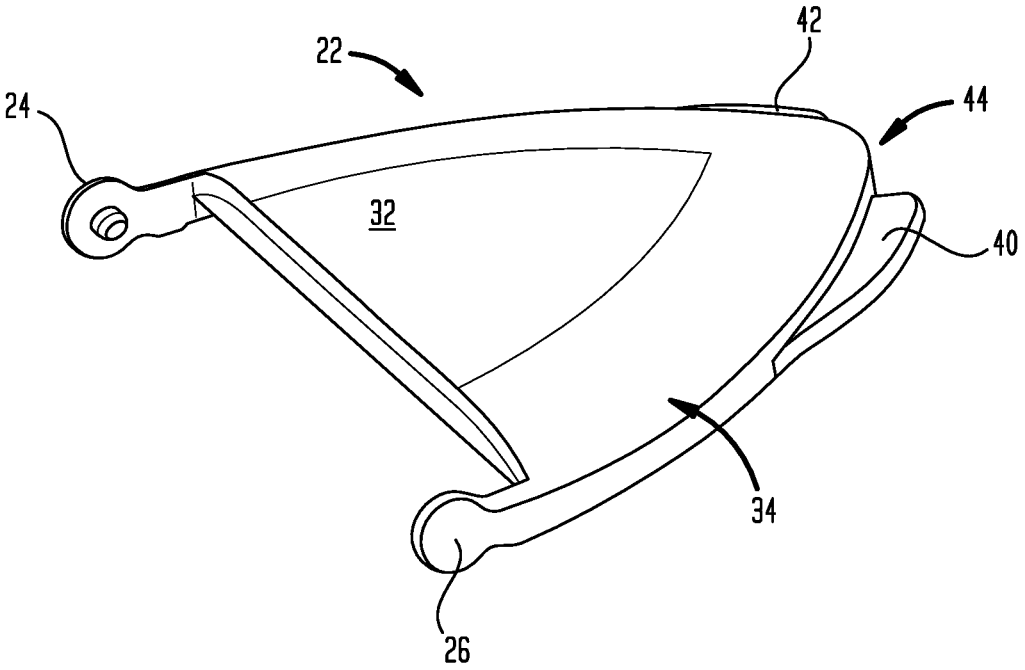
FIG. 7 is a perspective view of the lid of the case for tailor's chalk.
Figure 8:
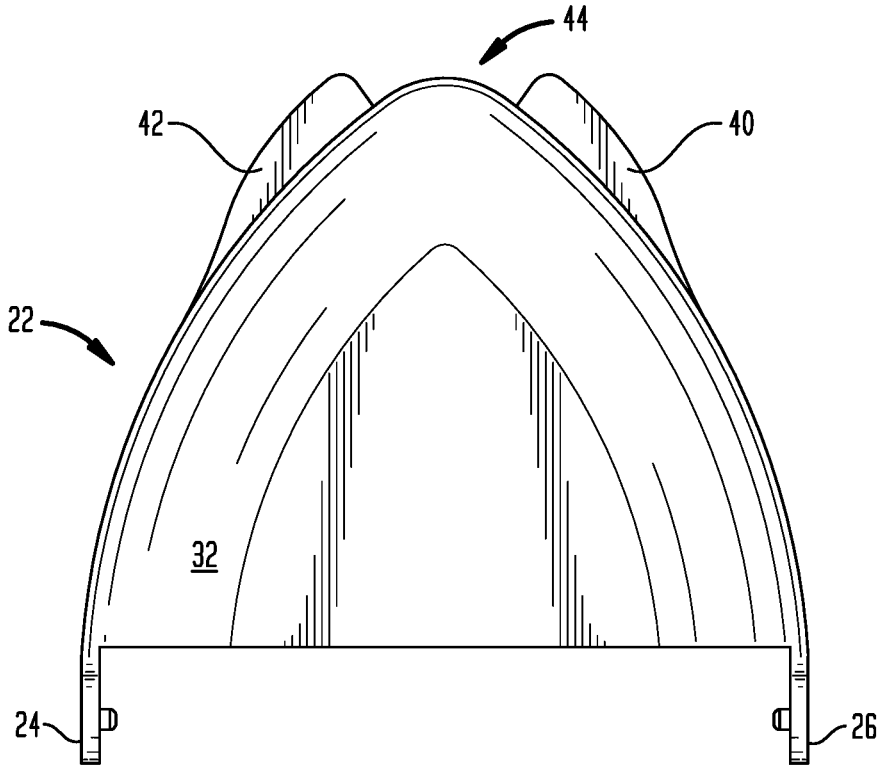
FIG. 8 is a plan view of the lid of FIG. 7.

Referring to the Figures, there is shown a case 10 for tailor's chalk comprising: (a) a base 12 with a base central portion 14, a retaining pocket 16 at one edge thereof and a pair of base hinge elements 18, 20 adjacent the pocket; and (b) a lid 22 shaped and adapted to mate with base 12 and hinged thereto by a pair of lid hinge elements 24, 26 to define a storage cavity 28 for the chalk 30 in a closed position shown in FIG. 1, the lid having a lid central portion 32 opposing the central portion of the base in said closed position, the lid being coupled to the base so as to be rotatable with respect thereto to an open position as is shown in FIG. 2 where the lid is rotated by 180° with respect to the closed position of FIG. 1 such that and the chalk is accessible. The lid is further rotatable with respect to the base to a work stand position shown in FIG. 3, where the lid is rotated by slightly more than approximately 270° with respect to the closed position such that the base is in an erect open position where the chalk is accessible to a multi-tasking user.

The lid defines a sidewall 34 at the periphery of its central portion to define portions of the storage cavity which is closely sized to the chalk. Preferably, the lid is transparent or translucent.

In most cases, the lid and base are made of thermoplastic material; for example, the base is made of acrylonitrile butadiene styrene copolymer and the lid is made of polystyrene.

Generally, the lid is rotatable with respect to the base over an angle of at least 230° with respect to the closed position. In order to configure the case as a work stand for the chalk, the lid is rotated with respect to the base over an angle of from 230° to 315° with respect to the closed position, which has an angle of rotation of 0° for reference. Typically when configuring the case as a work stand, the lid is rotated from 245° to 290° with respect to the closed position.

In a preferred embodiment, the base and lid are generally triangular.

Another preferred feature is wherein the base has a projecting base tab 36 at an apex 38 thereof.

Yet another preferred feature is wherein the lid has a pair of projecting lid tabs 40, 42 located adjacent an apex 44 thereof.

Figure 1:
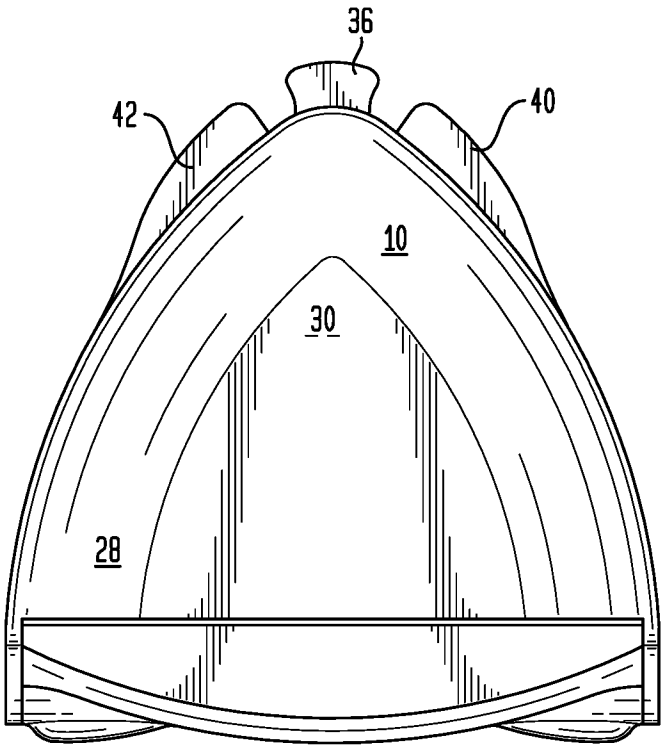
FIG. 1 is a plan view of an assembled case for tailor's chalk in a closed position containing an individual piece of tailor's chalk, wherein the lid is transparent indicated by oblique lines.

Preferably, the respective tabs are positioned such that the lid tabs 40, 42 are disposed on either side of the base tab 36 in a closed position as is illustrated in FIG. 1.

Figure 9:
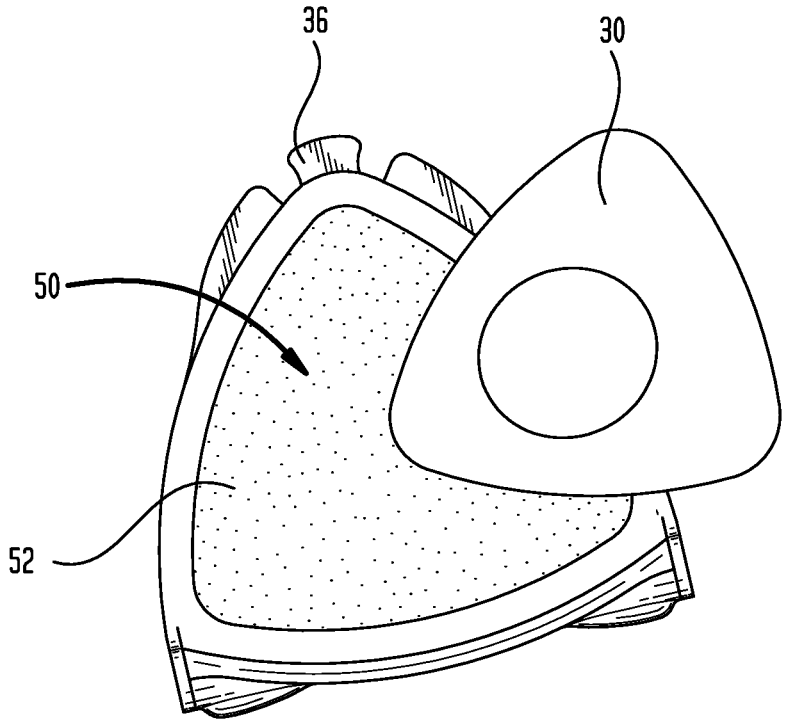
FIG. 9 is a perspective view showing the outerside of the base of another embodiment of the present invention showing an abrasive surface used to sharpen a tailor's chalk.
Figure 10:
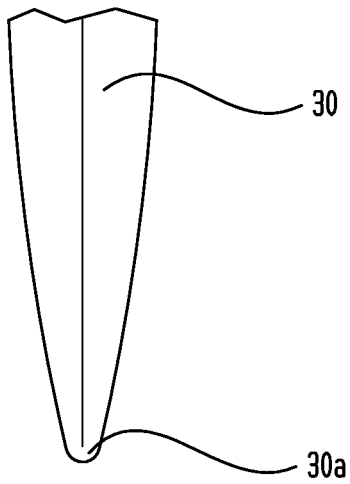
FIG. 10 is a schematic view of the profile of a sharpened tailor's chalk.

Still another feature useful in connection with the present invention is illustrated in FIGS. 9 and 10, wherein the outerside 50 of base 12 is provided with a roughened surface 52 suitable for sharpening a tailor's chalk, which invariably becomes dulled after repeated use. Surface 52 is roughened, which may be roughened by molding in texture or adding abrasive material, such as by adhering a sheet with affixed abrasive particles to the outerside 50, affixing abrasive particles to outerside 50 with a coating resin and so forth. Suitable roughened surfaces are generally akin to nail file surfaces. U.S. Pat. No. 6,694,988 to Blazek discloses a nail file with a roughened surface with a roughness varying from 10 to 100 microns, which may be used in connection with the present invention. The roughness is imparted to the surface by chemical etching or mechanical roughening with sandpapers, for example. See Col. 2, lines 43-52. U.S. Pat. No. 10,051,938 to Kim discloses providing surface roughness to a nail file by affixing abrasive particles to the surface with an epoxy resin. Alternatively, an abrasive sandpaper is adhered to a surface in order to achieve the desired roughness over the desired area.

Surface roughness may be expressed in grit size as is typical with sandpapers, or may be expressed in microns in accordance with the following tabular correlation:

| Grit Size | Surface Roughness ($10^{-6}$ m) |
|---|---|
| 80 | 1.80 |
| 120 | 1.32 |
| 150 | 1.06 |
| 180 | 0.76 |
| 240 | 0.38 |
| 320 | 0.30 |
| 500 | 0.18 |
| 600 | 0.13 |

In connection with the present invention, surface roughness from about 0.35 microns to 3.5 microns are most preferred.

There is thus provided a case for tailor's chalk, wherein the case has a roughened surface suitable for sharpening a tailor's chalk without the need for a separate sharpening tool. Most preferably, the roughened surface is an outer surface of the case.

In FIG. 10 there is shown a sharpened edge 30*a* of Chalk 30 after sharpening using the roughened surface of FIG. 9.

What is claimed is:

1. A case for tailor's chalk comprising:

(a) a base with a central portion, a retaining pocket at one edge thereof and a spaced apart pair of base hinge elements adjacent the pocket; and (b) a lid shaped and adapted to mate with the base and hinged thereto by a spaced apart pair of lid hinge elements to define a storage cavity for a tailor's chalk in a closed position, the lid having a central portion opposing the central portion of the base in said closed position, the lid being coupled to the base so as to be rotatable with respect thereto to an open position where the lid is rotated by 180° from the closed position and the tailor's chalk is accessible and wherein further the lid is rotatable with respect to the base to a work stand position where the lid is rotated by more than 220° from the closed position such that the base is in an erect open position where the tailor's chalk is accessible to a user.

2. The case according to claim 1, wherein the lid defines a sidewall at a periphery of its central portion to define portions of the storage cavity.

3. The case according to claim 1, wherein the lid is transparent or translucent.

4. The case according to claim 1, wherein the lid is rotatable with respect to the base over an angle of at least 230° with respect to the closed position.

5. The case according to claim 4, wherein the lid is rotatable with respect to the base over an angle of from 230° to 315° with respect to the closed position.

6. The case according to claim 1, wherein the base has a projecting base tab at an apex thereof.

7. The case according to claim 6, wherein the lid has a pair of projecting lid tabs located adjacent an apex thereof.

8. The case according to claim 7, wherein the lid tabs are disposed on either side of the base tab in a closed position.

9. The case according to claim 1, wherein the case has a roughened surface operative to sharpen the tailor's chalk.

10. The case according to claim 9, wherein the roughened surface is an outer surface of the case.

11. A case for tailor's chalk comprising:

(a) a generally triangular base with a central portion, a retaining pocket along one edge thereof, said pocket opening toward the center of said triangular base and a pair of offset base hinge elements adjacent the pocket located adjacent opposed ends of said pocket along said one edge of said base; and (b) a generally triangular lid shaped and adapted to mate with the base and hinged thereto by a pair of mating offset lid hinge elements located along one edge of said generally triangular lid, said lid hinge elements being snap-fit mateable with said base hinge elements, said generally triangular base and said generally triangular lid having an offset therebetween sufficient to define a storage cavity for a tailor's chalk in a closed position, the generally triangular lid having a central portion opposing the central portion of the base in said closed position, the generally triangular lid being coupled to the base so as to be rotatable with respect thereto to an open position where the generally triangular lid is rotated by 180° from the closed position and the tailor's chalk is accessible and wherein further the generally triangular lid is rotatable with respect to the base to a work stand position where the generally triangular lid is rotated by more than 270° from the closed position such that the base is in an erect open position leaning at least slightly rearwardly where the tailor's chalk is accessible to a user.

12. The case according to claim 11, wherein the generally triangular lid defines a sidewall at an outer periphery of its central portion to define portions of the storage cavity.

13. The case according to claim 11, wherein the generally triangular lid is at least translucent.

14. The case according to claim 11, wherein the generally triangular lid is rotatable with respect to the base over an angle of at least 271° with respect to the closed position.

15. The case according to claim 11, wherein the generally triangular lid is rotatable with respect to the base over an angle of from 271° to about 315° with respect to the closed position.

16. The case according to claim 11, wherein the base has a projecting base tab at an apex thereof.

17. The case according to claim 16, wherein the generally triangular lid has a pair of projecting lid tabs located adjacent the projecting base tab of the base in a closed position.

18. The case according to claim 11, wherein the case has a roughened surface suitable for sharpening the tailor's chalk.

19. The case according to claim 18, wherein the roughened surface is an outer surface of the case.

20. The case according to claim 19, wherein the roughened surface has a surface roughness of from 0.35 microns to 3.5 microns.

* * * * *